US011557448B2

(12) United States Patent
Hoffmann et al.

(10) Patent No.: US 11,557,448 B2
(45) Date of Patent: Jan. 17, 2023

(54) SWITCHING DEVICE

(71) Applicant: TDK Electronics AG, Munich (DE)

(72) Inventors: Robert Hoffmann, Berlin (DE); Frank Werner, Berlin (DE)

(73) Assignee: TDK Electronics AG, Munich (DE)

( * ) Notice: Subject to any disclaimer, the term of this patent is extended or adjusted under 35 U.S.C. 154(b) by 0 days.

(21) Appl. No.: 17/045,928

(22) PCT Filed: Apr. 16, 2019

(86) PCT No.: PCT/EP2019/059802
§ 371 (c)(1),
(2) Date: Oct. 7, 2020

(87) PCT Pub. No.: WO2019/201916
PCT Pub. Date: Oct. 24, 2019

(65) Prior Publication Data

US 2021/0151269 A1 May 20, 2021

(30) Foreign Application Priority Data

Apr. 19, 2018 (DE) ..... 102018109389.6

(51) Int. Cl.
*H01H 33/22* (2006.01)
*H01H 33/18* (2006.01)
(Continued)

(52) U.S. Cl.
CPC ..... *H01H 33/78* (2013.01); *H01H 33/182* (2013.01); *H01H 33/22* (2013.01); *H01H 33/38* (2013.01)

(58) Field of Classification Search
CPC ..... H01H 1/20; H01H 9/443; H01H 9/302; H01H 9/346; H01H 33/182; H01H 33/78;
(Continued)

(56) References Cited

U.S. PATENT DOCUMENTS 5,546,061 A * 8/1996 Okabayashi ..... H01H 9/443 335/126
5,892,194 A * 4/1999 Uotome ..... H01H 51/065 218/68
(Continued)

FOREIGN PATENT DOCUMENTS

CN 1770351 A 5/2006
CN 1879182 A 12/2006
(Continued)

OTHER PUBLICATIONS

CN105132726 (Original document published Dec. 9, 2015) (Year: 2015).*

*Primary Examiner* — William A Bolton
(74) *Attorney, Agent, or Firm* — Slater Matsil, LLP

(57) ABSTRACT

In an embodiment a switching device includes at least one stationary contact in a switching chamber containing a gas comprising $H_2$ and one movable contact in the switching chamber, wherein the switching chamber has a switching chamber wall and a switching chamber base, and wherein the switching chamber at least partially comprises a polymer material configured to release hydrogen when heated.

20 Claims, 3 Drawing Sheets

(51) Int. Cl.
*H01H 33/38* (2006.01)
*H01H 33/78* (2006.01)

(58) Field of Classification Search
CPC ..... H01H 50/546; H01H 50/16; H01H 2050/025; H01H 73/045; H01H 51/06; H01H 1/0206; H01H 1/025; H01H 2001/0057; H01H 1/205; H01H 2009/348
USPC ..... 218/22, 13, 30, 31, 34, 68; 335/201, 202
See application file for complete search history.

(56) References Cited

U.S. PATENT DOCUMENTS 6,521,830 B1 * 2/2003 Platz ..... B29C 70/72 174/50
7,186,941 B2 3/2007 Yeon
7,852,178 B2 * 12/2010 Bush ..... H01H 50/023 335/126
7,859,373 B2 * 12/2010 Yamamoto ..... H01H 50/305 335/126
8,274,347 B2 * 9/2012 Eum ..... H01H 9/341 335/201
8,549,734 B2 * 10/2013 Yeon ..... H01H 49/00 29/622
8,558,648 B2 * 10/2013 Choi ..... H01H 51/065 335/83
9,691,560 B2 6/2017 Zahlmann et al.
10,102,991 B2 10/2018 Kanematsu et al.
10,276,314 B2 4/2019 Minke et al.
2008/0122562 A1 5/2008 Bush et al.
2011/0032059 A1 * 2/2011 Ito ..... H01H 50/14 335/202

FOREIGN PATENT DOCUMENTS

CN 105132726 A * 12/2015 ..... B22F 1/00
CN 105531783 A 4/2016
DE 102007055667 A1 5/2008
DE 102011118713 A1 9/2012
DE 112014003951 T5 6/2016
EP 0798752 A2 10/1997
EP 1168392 B 5/2005
GB 1140612 A 1/1969
JP S4730470 B1 8/1972
JP H07235248 A 9/1995
JP H09259728 A 10/1997
JP H10162676 A 6/1998
JP H10294036 A 11/1998
JP 2001160449 A 6/2001
JP 2014107050 A 6/2014
JP 2015049937 A 3/2015
JP 2016134383 A 7/2016
JP 2017117678 A 6/2017
WO 2006040418 A 4/2006

* cited by examiner

SWITCHING DEVICE

This patent application is a national phase filing under section 371 of PCT/EP2019/059802, filed Apr. 16, 2019, which claims the priority of German patent application 102018109389.6, filed Apr. 19, 2018, each of which is incorporated herein by reference in its entirety.

TECHNICAL FIELD

A switching device is specified. The switching device is embodied, in particular, as a remotely operated, electromagnetically acting switch which can be operated by electrically conductive current. The switching device can be activated via an electrical control circuit and can switch an electrical load circuit. In particular, the switching device can be embodied as a relay or as a contactor, in particular as a power contactor. The switching device may particularly preferably be embodied as a gas-filled power contactor.

BACKGROUND

One possible application for switching devices of this kind, in particular power contactors, is opening and isolating electrical battery circuits, for example, in motor vehicles such as electrically or partially electrically driven motor vehicles. These may be, for example, purely battery-operated vehicles (BEV: "battery electric vehicle"), hybrid electric vehicles which can be charged via a power outlet or charging station (PHEV: "plug-in hybrid electric vehicle") and hybrid electric vehicles (HEV). In general here, both the positive and the negative contact of the battery are isolated using a power contactor. This disconnection is performed in normal operation for example when the vehicle is at a standstill and also in the event of a disturbance such as an accident or the like. The main task of the power contactor here is to switch the vehicle to a deenergized state and to interrupt the flow of current. In particular, in the event of a fault, switching arcs occur when the current is interrupted. These switching arcs have to be quenched in order to safely interrupt the current flow and prevent destruction of the switch.

A hydrogen-containing gas filling and in addition additional permanent magnets, so-called blowout magnets which can deflect the arcs, in the region of the arcs which occur are usually used in order to quench the arc. By way of example, European Application No. EP 1168 392 A1 describes blowout magnets of this kind.

Furthermore, outgassing plastics such as unsaturated polyester or nylon in the vicinity of an arc can lead to an improvement in the quenching behavior. However, the disadvantage of said outgassing plastics is their high carbon content which, in the event of evaporation of the plastic, can lead to conductive coatings on the chamber inner wall, in particular owing to the formation of graphite, and as a result adversely affect the dielectric strength or, in the worst case, can lead to a short circuit of the contacts.

SUMMARY

Embodiments provide a switching device, particularly preferably a switching device in which described disadvantages of the prior art can be avoided or at least reduced.

According to one embodiment, a switching device has at least one stationary contact and at least one movable contact. The at least one stationary contact and the at least one movable contact are intended and embodied to switch on and switch off an electrical load circuit which can be connected to the switching device. The movable contact can move in the switching device in a corresponding manner between a non-switched-through state and a switched-through state of the switching device in such a way that the movable contact is at a distance from the at least one stationary contact and is therefore DC-isolated in the non-switched-through state of the switching device and is in mechanical contact with the at least one stationary contact and is therefore electrically conductively connected to the at least one stationary contact in the switched-through state. The switching device particularly preferably has at least two stationary contacts which are arranged in the switching device in a manner isolated from one another and in this way can be electrically conductively connected to one another or electrically isolated from one another by the movable contact depending on the state of the movable contact.

According to a further embodiment, the switching device has a housing in which the movable contact and the at least one stationary contact or the at least two stationary contacts are arranged. The movable contact can be arranged, in particular, entirely in the housing. The fact that a stationary contact is arranged in the housing can mean, in particular, that at least the contact region of the stationary contact, which is in mechanical contact with the movable contact in the switched-through state, is arranged within the housing. For connection of a supply line of an electrical circuit which is to be switched by the switching device, electrical contact can be made with a stationary contact, which is arranged in the housing, from the outside, that is to say from outside the housing. To this end, a stationary contact which is arranged in the housing can project out of the housing by way of one portion and have a connection facility for a supply line outside the housing.

According to a further embodiment, the contacts are arranged in a gas atmosphere in the housing. This can mean, in particular, that the movable contact is arranged entirely in the gas atmosphere in the housing, and that furthermore at least portions of the stationary contact or contacts, for example the contact region or regions of the stationary contact or contacts, are arranged in the gas atmosphere in the housing. The switching device can accordingly particularly preferably be a gas-filled switching device such as a gas-filled contactor.

According to a further embodiment, the contacts, that is the movable contact entirely and at least portions of the stationary contact or contacts, are arranged in a switching chamber within the housing, in which switching chamber the gas, that is to say at least a portion of the gas atmosphere, is located. The gas can preferably have an $H_2$ content of at least 50%. In addition to hydrogen, the gas can comprise an inert gas, particularly preferably $N_2$ and/or one or more noble gases.

The switching chamber can have a switching chamber base and a switching chamber wall. The movable contact can be connected to a shaft, wherein the shaft projects through an opening in the switching chamber base. The switching chamber wall can have at least one opening, wherein the at least one stationary contact can project through the opening in the switching chamber wall. If the switching device has a plurality of stationary contacts, the switching chamber wall can preferably have a corresponding opening for each of the stationary contacts. The switching chamber wall can particularly preferably be shaped in a cap-like manner and be in one or several parts. The switching chamber base can particularly preferably be of plate-like design and likewise be in one or several parts. As an alternative, the switching chamber base and the switching chamber wall can also be shaped conversely. Furthermore, it may also be possible for the switching chamber base and the switching chamber wall to both be of cap-like design. Irrespective of the shape of the switching chamber wall and the switching chamber base, they can particularly preferably be arranged in relation to one another such that a space which is enclosed apart from the above described openings is formed, the switching processes described further above taking place in said space.

According to a further embodiment, the switching chamber at least partially comprises a polymer material from which hydrogen can be released when it is heated. In particular, the polymer material can be embodied in such a way that hydrogen can be released owing to an arc, as can occur in the event of a switching process in the switching chamber. The additionally released hydrogen, particularly preferably in the form of $H_2$, can improve arc quenching in the switching chamber.

For example, the switching chamber base can at least partially comprise the polymer material. This can mean that the switching chamber base can have a plastic shield which comprises the polymer material. Furthermore, the switching chamber base can also be formed from the polymer material.

As an alternative or in addition, the switching chamber wall can at least partially comprise the polymer material. In particular, a portion of the switching chamber wall can comprise the polymer material. Furthermore, the switching chamber wall can also be formed from the polymer material.

According to a further embodiment, the polymer material contains a polyoxymethylene (POM). The polymer material is particularly preferably a POM. POM is a partially crystalline, largely linear, thermoplastic which can be produced by chain polymerization or chain copolymerization and has the repeating unit —CHR—O—, wherein R denotes an organic radical. The polymer material particularly preferably has the structure $(CH_2O)_n$, that is to say with hydrogen as the radical R, or is formed by it. The polymer material can accordingly be distinguished by a comparatively low carbon content and a very low tendency to form graphite. Owing to the identical contents of carbon and oxygen, in particular in the case of $(CH_2O)_n$, predominantly gaseous CO and $H_2$ can be produced in the case of heat- and, in particular, arc-induced decomposition. Therefore, hardly any conductive wall coatings are produced as a result and the additional hydrogen boosts arc quenching.

According to a further embodiment, at least one blowout magnet is arranged in the switching chamber, which blowout magnet can particularly preferably be formed by a permanent magnet. Furthermore, a plurality of blowout magnets can also be present. In the case of a switch-off process of the switching device under load, that is to say spatial separation of the movable contact and the one or more stationary contacts when load current is still flowing, the arc which is produced in the process is deflected by the blowout magnet or magnets and driven out of the contact region. In the process, it can in particular also reach a portion of the switching chamber, for example the switching chamber base. By heating this portion, which preferably comprises the described polymer material, that is to say in particular containing or consisting of POM, additional hydrogen can then be released as described above, so that extinguishing of the arc can be accelerated.

BRIEF DESCRIPTION OF THE DRAWINGS

Further advantages, advantageous embodiments and developments can be found in the exemplary embodiments described below in conjunction with the Figures, in which.

Figure 1A:
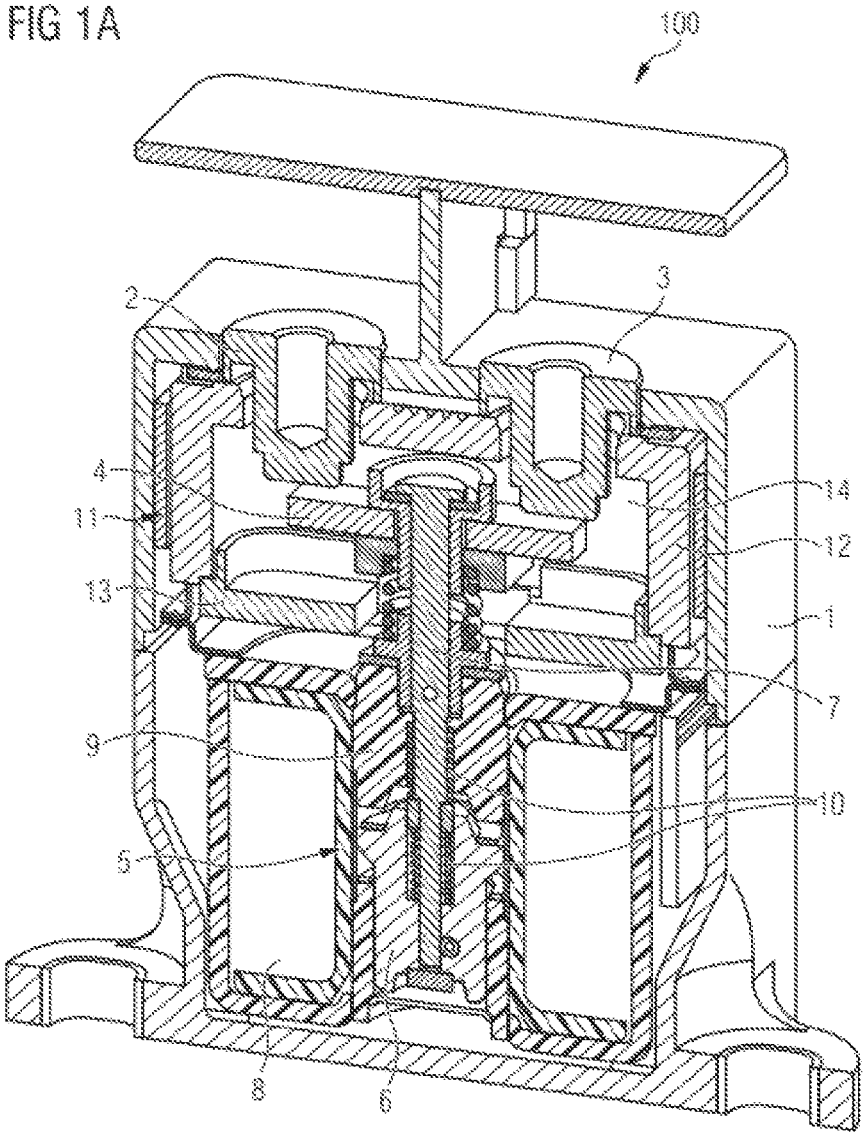
FIGS. 1A and 1B show schematic illustrations of a switching device according to an exemplary embodiment.

In the embodiments and Figures, identical, similar or identically acting elements are provided in each case with the same reference numerals. The elements illustrated and their size ratios to one another should not be regarded as being to scale, but rather individual elements, such as for example layers, components, devices and regions, may have been made exaggeratedly large to illustrate them better and/or to aid comprehension.

DETAILED DESCRIPTION OF ILLUSTRATIVE EMBODIMENTS

Figure 1B:
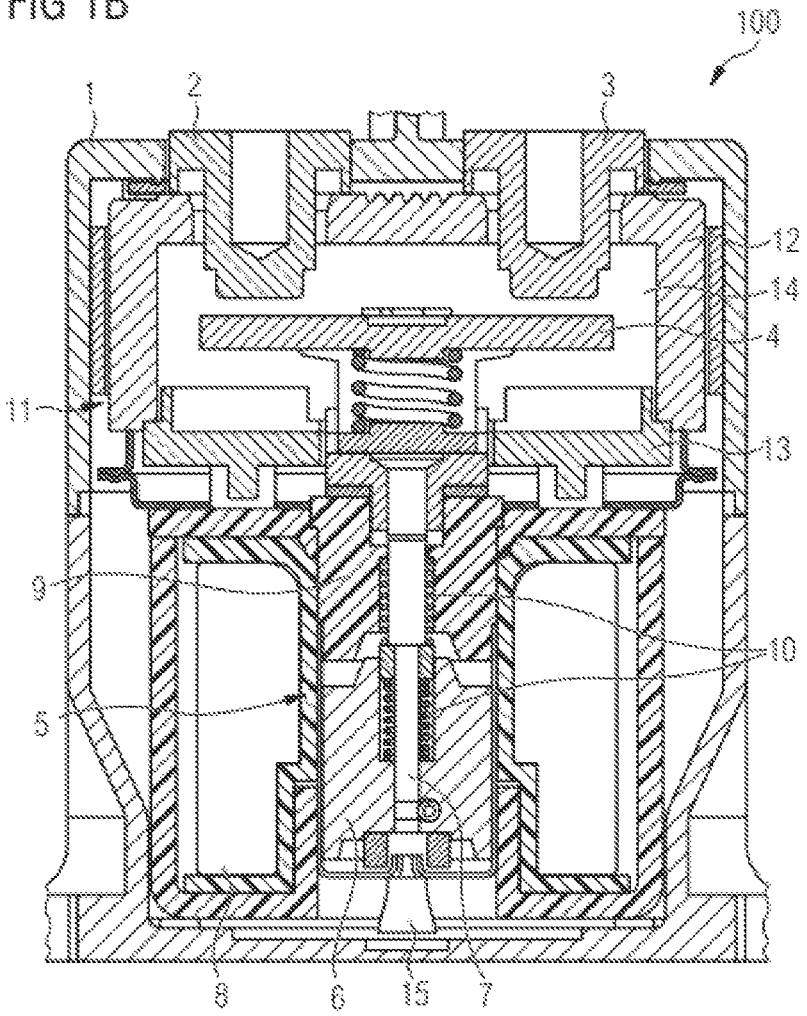

FIGS. 1A and 1B show an exemplary embodiment of a switching device 100 which can be used, for example, for switching high electric currents and/or high electric voltages and which can be a relay or a contactor, in particular a power contactor.

FIG. 1A shows a three-dimensional sectional illustration, while a two-dimensional sectional illustration is illustrated in FIG. 1B. The description which follows relates equally to FIGS. 1A and 1B. The geometries shown are to be understood merely by way of example and in a non-limiting manner, and can also be embodied in an alternative manner.

The switching device 100 has two stationary contacts 2, 3 and one movable contact 4 in a housing 1. The movable contact 4 is embodied as a contact plate. The stationary contacts 2, 3 together with the movable contact 4 form the switching contacts. The housing 1 serves primarily as protection against contact with the components which are arranged in the interior and comprises or consists of a plastic, for example polybutylene terephthalate (PBT) or glass-filled PBT. The contacts 2, 3, 4 can, for example, contain or consist of copper, a copper alloy or a mixture of copper with at least one further metal, for example tungsten, nickel and/or chromium.

FIGS. 1A and 1B show the switching device 100 in an inoperative state in which the movable contact 4 is spaced apart from the stationary contacts 2, 3, so that the contacts 2, 3, 4 are DC-isolated from one another. The design shown for the switching contacts and in particular the geometry thereof are to be understood purely by way of example and in a non-limiting manner. As an alternative, the switching contacts can also be embodied differently. For example, it may be possible for just one of the switching contacts to be embodied to be stationary.

The switching device 100 has a movable magnet armature 5 which substantially performs the switching movement. The magnet armature 5 has a magnetic core 6, for example comprising or consisting of a ferromagnetic material. Furthermore, the magnet armature 5 has a shaft 7 which is guided through the magnetic core 6 and, at one shaft end, is fixedly connected to the magnetic core 6. At the other shaft end which is situated opposite the magnetic core 6, the magnet armature 5 has the movable contact 4 which is likewise connected to the shaft 7. The shaft 7 can for example be manufactured with or from stainless steel.

The magnetic core 6 is surrounded by a coil 8. A current flow, which can be introduced from outside, in the coil 8 generates a movement of the magnetic core 6 and therefore of the entire magnet armature 5 in an axial direction until the movable contact 4 makes contact with the stationary contacts 2, 3. The magnet armature 5 therefore moves from a first position, which corresponds to the inoperative state and simultaneously to the isolating, that is to say non-switched-through, state, to a second position, which corresponds to the active, that is to say switched-through, state. In the active state, the contacts 2, 3, 4 are electrically conductively connected to one another. In another embodiment, the magnet armature 5 can alternatively also execute a rotary movement. The magnet armature 5 can be embodied, in particular, as a tie rod or as a hinged armature. In order to guide the shaft 7 and therefore the magnet armature 5, the switching device 100 has a yoke 9 which can comprise or consist of pure iron or a low-doped iron alloy and forms a portion of the magnetic circuit. The yoke 9 has an opening in which the shaft 7 is guided. If the current flow in the coil 8 is interrupted, the magnet armature 5 is moved back to the first position by one or more springs 10. The switching device 100 is then back in the inoperative state in which the contacts 2, 3, 4 are open.

When the contacts 2, 3, 4 are opened, an arc may be formed which can damage the contact areas. As a result, there may be a risk of the contacts 2, 3, 4 remaining "stuck" to one another owing to welding caused by the arc and no longer being separated from one another. In order to prevent the formation of arcs of this kind or at least to assist in quenching of arcs which occur, the contacts 2, 3, 4 are arranged in a gas atmosphere, so that the switching device 100 is embodied as a gas-filled relay or gas-filled contactor. To this end, the contacts 2, 3, 4 are arranged within a switching chamber 11, formed by a switching chamber wall 12 and a switching chamber base 13, in a hermetically sealed portion of the housing 1. The housing 1 and, in particular, the hermetically sealed portion of the housing 1 completely surround the magnet armature 5 and the contacts 2, 3, 4. The hermetically sealed portion of the housing 1 and therefore also the switching chamber 11 are filled with a gas 14. The gas 14, which can be introduced via a gas-filling port 15 within the scope of the production of the switching device 100, can particularly preferably contain hydrogen. In particular, the gas 14 can comprise at least 50% or more $H_2$ in an inert gas such as $N_2$ and/or one or more noble gases since hydrogen-containing gas can promote quenching of arcs.

In the exemplary embodiment shown, the switching chamber wall 12 is of cap-like design and can be in one or several parts. The switching chamber base 13 is of plate-like design and can likewise be in one or several parts. The shaft 7, which is connected to the movable contact 4, and the stationary contacts 2, 3 can project through the switching chamber base 13 and the switching chamber wall 12 through openings in said parts. The switching chamber wall 12 and the switching chamber base 13 therefore surround a space in which the switching processes take place. As an alternative to the exemplary embodiment shown, other geometries of the switching chamber wall 12 and of the switching chamber base 13 are also possible.

Furthermore, the switching chamber 11 at least partially comprises a polymer material from which hydrogen can be released when it is heated. In particular, the polymer material is formed in such a way that hydrogen can be released owing to an arc which strikes the polymer material, so that the additionally released hydrogen, particularly preferably in the form of $H_2$, can improve arc quenching. The polymer material comprises a polyoxymethylene (POM), in particular with the structure $(CH_2O)_n$, or is formed by it. As is described in the general part, a polymer material of this kind is distinguished by a carbon content which is low in comparison to other polymers and a very low tendency to form graphite, wherein predominantly gaseous CO and $H_2$ are produced in the case of in particular arc-induced decomposition.

The switching chamber base 13 particularly preferably comprises the polymer material. For example, a polymer shield which forms a portion of the switching chamber base 13 comprising and preferably consisting of the polymer material can prevent an arc reaching the flange arc situated beneath it. Furthermore, the switching chamber base 13 as a whole can also be formed from the polymer material. As an alternative or in addition, portions of the switching chamber wall 12 or else the switching chamber wall 12 as a whole can also be formed with or from the polymer material. Those portions of the switching chamber 11 that are not formed by the described polymer material, that is to say in particular portions of the switching chamber wall 12 and/or of the switching chamber base 13 that are not formed by the described polymer material, can be manufactured, for example, with or from a metal oxide, such as $Al_2O_3$ for example.

Figure 2:
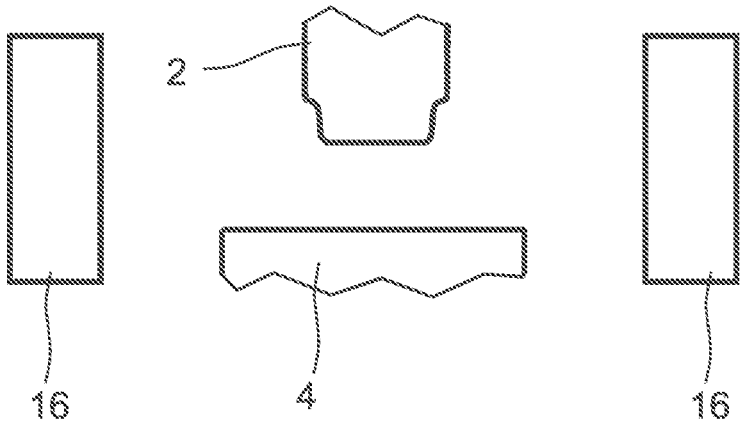
FIG. 2 shows a schematic illustration of a portion of a switching device according to a further exemplary embodiment.

FIG. 2 shows a detail of the contacts 2, 4 which are arranged in the switching chamber, wherein the illustration of FIG. 2 is rotated through 90° in relation to the sectional planes of FIGS. 1A and 1B. As is indicated in FIG. 2, one or more blowout magnets 16, that is to say preferably permanent magnets, can be arranged within the switching chamber, which magnets can extend the arc path and deflect the arcs from the region between the contacts. In this case, the arcs can also reach a part of the switching chamber, for example the switching chamber base or the switching chamber wall. By heating this portion, which comprises or preferably consists of the described polymer material, that is to say in particular containing or consisting of POM, additional hydrogen can then be released as described above, so that extinguishing of the arc can be accelerated.

The features and exemplary embodiments described in conjunction with the Figures can be combined with one another according to further exemplary embodiments, even if not all combinations have been explicitly described. Furthermore, the exemplary embodiments described in conjunction with the Figures may alternatively or additionally comprise further features in accordance with the description in the general part.

The invention is not restricted to the exemplary embodiments by the description on the basis of said exemplary embodiments. Rather, the invention encompasses any novel feature and any combination of features, which in particular comprises any combination of features in the patent claims, even if this feature or this combination is not itself explicitly specified in the patent claims or exemplary embodiments.

The invention claimed is:

1. A switching device comprising:

at least one stationary contact in a switching chamber containing a gas comprising $H_2$; and at least one movable contact in the switching chamber, wherein the switching chamber has a switching chamber wall and a switching chamber base, wherein he switching chamber wall has at least one opening, wherein the at least one stationary contact projects through the opening in the switching chamber wall, wherein the movable contact is connected to a shaft that projects through an opening in the switching chamber base, wherein the switching chamber wall and the switching chamber base are arranged in relation to one another such that a space is formed which is enclosed except for the above described openings, wherein the switching chamber base at least partially comprises a polymer material configured to release hydrogen when heated, and/or wherein the switching chamber wall at least partially comprises the polymer material configured to release the hydrogen when heated.

2. The switching device according to claim 1, wherein the switching chamber base has a plastic shield comprising the polymer material.

3. The switching device according to claim 1, wherein the switching chamber base consists essentially of the polymer material.

4. The switching device according to claim 1, wherein the switching chamber wall consists essentially of the polymer material.

5. The switching device according to claim 1, wherein the polymer material comprises a polyoxymethylene.

6. The switching device according to claim 5, wherein the polyoxymethylene has a $(CH_2O)_n$ structure.

7. The switching device according to claim 1, wherein at least one blowout magnet is arranged in the switching chamber.

8. The switching device according to claim 1, wherein the gas has an $H_2$ content of at least 50%.

9. The switching device according to claim 1, wherein the at least one stationary contact comprises copper and the one movable contact comprises copper.

10. The switching device according to claim 1, wherein the at least one stationary contact comprises copper and a further metal and the one movable contact comprises copper and the further metal.

11. The switching device according to claim 10, wherein the further metal is W, Ni and/or Cr.

12. The switching device according to claim 1, wherein the one movable contact is connected to an armature comprising a magnetic core via the shaft.

13. The switching device according to claim 12, further comprising a housing and a magnetic coil, wherein the switching chamber and the magnetic coil are located inside the housing one above another in an axial direction, wherein the magnetic coil surrounds the magnetic core, and wherein magnetic coil is configured to move the magnetic core via a magnetic field.

14. A switching device comprising:

at least one stationary contact in a switching chamber containing a gas comprising $H_2$; and at least one movable contact in the switching chamber, wherein the switching chamber has a switching chamber wall and a switching chamber base, wherein he switching chamber wall has at least one opening, wherein the at least one stationary contact projects through the opening in the switching chamber wall, wherein the movable contact is connected to a shaft that projects through an opening in the switching chamber base, wherein the switching chamber wall and the switching chamber base are arranged in relation to one another such that a space is formed which is enclosed except for the above described openings, and wherein the switching chamber base and/or the switching chamber wall at least partially comprise(s) a polymer material configured to release hydrogen when heated.

15. The switching device according to claim 14, wherein the switching chamber base has a plastic shield comprising the polymer material.

16. The switching device according to claim 14, wherein the switching chamber base consists essentially of the polymer material.

17. The switching device according to claim 14, wherein the switching chamber wall consists essentially of the polymer material.

18. The switching device according to claim 14, wherein the polymer material comprises a polyoxymethylene.

19. The switching device according to claim 18, wherein the polyoxymethylene has a $(CH_2O)_n$ structure.

20. The switching device according to claim 14, wherein the gas has an $H_2$ content of at least 50%.

* * * * *